US008720747B2

(12) United States Patent
Hoagland et al.

(10) Patent No.: US 8,720,747 B2
(45) Date of Patent: May 13, 2014

(54) SLEEVE ACTIVATED COMPRESSED FLUID DISPENSING DEVICE WITH INTERNAL SEAL

(75) Inventors: Mary M. Hoagland, Midland, MI (US); Peter J. Schulz, Midland, MI (US); Christopher J. Siler, Hemlock, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 13/982,391

(22) PCT Filed: Feb. 16, 2012

(86) PCT No.: PCT/US2012/025331

§ 371 (c)(1),
(2), (4) Date: Jul. 29, 2013

(87) PCT Pub. No.: WO2012/115841

PCT Pub. Date: Aug. 30, 2012

(65) Prior Publication Data

US 2013/0320045 A1 Dec. 5, 2013

Related U.S. Application Data

(60) Provisional application No. 61/446,620, filed on Feb. 25, 2011.

(51) Int. Cl.

| | |
|---|---|
| ***B05B 1/30*** | (2006.01) |
| ***B65D 83/20*** | (2006.01) |
| ***B65D 83/30*** | (2006.01) |
| ***B65D 83/46*** | (2006.01) |

(52) U.S. Cl.
USPC ..... 222/402.13; 222/402.21; 222/501; 239/579

(58) Field of Classification Search
USPC ..... 222/528–530, 548, 549, 402.13, 501, 222/329, 153.11, 153.1, 153.14, 525, 518, 222/514, 571; 137/315.25; 215/329, 342, 215/346, 361, 356, 311, 314, 315; 239/579
See application file for complete search history.

(56) References Cited

U.S. PATENT DOCUMENTS 3,249,267 A * 5/1966 Carrion, Jr. et al. ..... 222/192
3,357,604 A 12/1967 Arthur (Continued)

FOREIGN PATENT DOCUMENTS

| | | |
|---|---|---|
| DE | 8603478 | 7/1986 |
| EP | 0670275 | 9/1995 |
| GB | 1445202 | 8/1976 |

OTHER PUBLICATIONS

Great Stuff Pro Foam Dispensing Guns, pp. 1-6, The Dow Chemical Company, Midland, MI.

*Primary Examiner* — Paul R Durand
*Assistant Examiner* — Charles P Cheyney
(74) *Attorney, Agent, or Firm* — Steven W. Mork

(57) ABSTRACT

A dispensing device for dispensing compressed fluid from a can through a valve stem of the can has a hollow tube with a channel extending through it from an entrance end to an opposing dispensing end, a connector defining a conduit therethrough that is in fluid communication with the channel of the hollow tube and that attaches to a valve stem of a can, a plug located within the channel of the hollow tube that forms a sealing configuration within the channel when pressed towards the dispensing end of the channel, and a sleeve that wraps at least partially around the hollow tube and that has a protrusion that upon activating the sleeve extends through the dispensing end of the hollow tube and prevents the plug from establishing a sealing configuration with the hollow tube.

15 Claims, 7 Drawing Sheets

(56) References Cited

U.S. PATENT DOCUMENTS

| | | | | |
|---|---|---|---|---|
| 3,419,197 | A | 12/1968 | Battaglia | |
| 3,506,165 | A | 4/1970 | Beard | |
| 3,920,165 | A | 11/1975 | Schultz | |
| 4,008,834 | A | 2/1977 | Towns | |
| 4,418,847 | A | 12/1983 | Beard | |
| 4,860,933 | A | 8/1989 | Morane | |
| 4,895,280 | A * | 1/1990 | Tourigny | 222/402.13 |
| 5,085,353 | A | 2/1992 | Inui et al. | |
| 5,205,443 | A | 4/1993 | Inui et al. | |
| 5,305,930 | A | 4/1994 | De Laforcade | |
| 5,423,458 | A * | 6/1995 | Tourigny | 222/192 |
| 5,533,649 | A * | 7/1996 | Von Schuckmann | 222/153.14 |
| 5,549,226 | A | 8/1996 | Kopp | |
| 5,624,055 | A | 4/1997 | Clanet et al. | |
| 5,772,077 | A | 6/1998 | Tafur | |
| 6,213,351 | B1 * | 4/2001 | Stoneberg et al. | 222/153.14 |
| 6,431,465 | B1 | 8/2002 | Yie | |
| 8,281,962 | B2 * | 10/2012 | Ogawa et al. | 222/501 |

* cited by examiner

Figure 1(a)
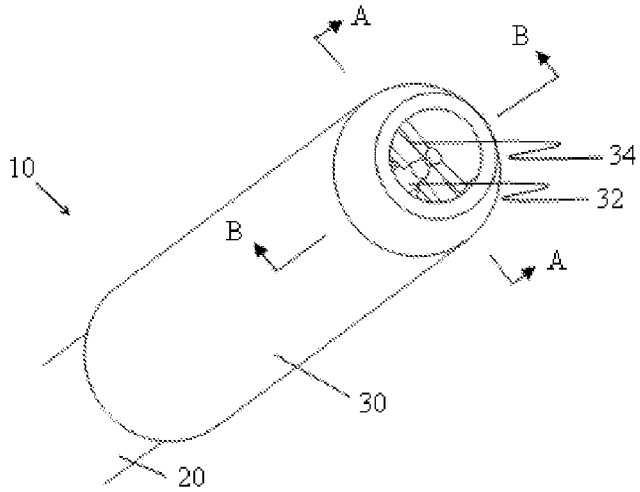
Figure 1(b)
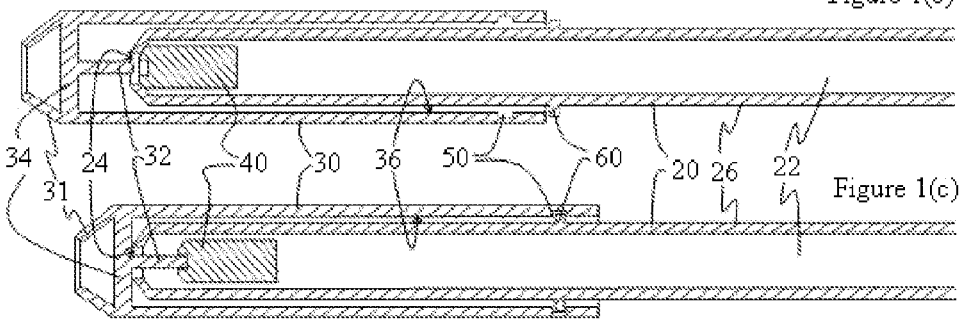
Figure 1(c)
Figure 1(d)
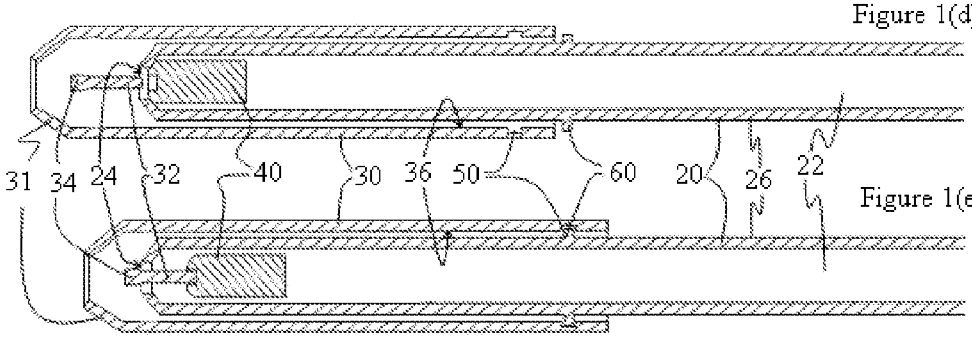
Figure 1(e)

SLEEVE ACTIVATED COMPRESSED FLUID DISPENSING DEVICE WITH INTERNAL SEAL

BACKGROUND OF THE INVENTION

1. Field of the Invention

The present invention relates to a dispensing device for dispensing compressed fluid from a can and a dispensing system comprising the dispensing device and can.

2. Description of Related Art

Dispensing fluid, particularly foamable fluid, from a compressed can is useful for many do-it-yourself products. One such product is spray foam for sealing and thermal insulation applications. Spray foam is available as foamable liquid under pressure in a can. It is common to dispense the foamable liquid through an application tube (or straw) attached to a valve or valve stem on the can. Upon release from the pressurized can the foamable liquid expands into foam and fills gaps and/or provides a thermal insulating seal. Foamable liquids include foamable latex and foamable polyurethane formulations.

One challenge with spray foam is that residual foamable formulation in the application tube of the dispenser is free to continue to expand after applying spray foam formulation to a location. The residual foamable liquid continues to expand and expel from the application tube even after application of the foamable liquid is complete. The expanding residual foamable liquid can drip from the application tube to create unintended messes. Alternatively, the user must periodically wipe clean the dispensing end of the application tube as residual foamable liquid expands within the tube. To avoid drips and the need to continually wipe the end of an application tube, it would be desirable to have a dispensing device for use with compressed expandable liquids that would obviate continuous expansion of residual foamable liquid out from an application tube after desired application of the foamable liquid is complete.

U.S. Pat. No. 5,549,226 ('226) discloses a device for operating propellant cans that can be useful for addressing the aforementioned problem. The device in '226 comprises a bendable application tube that can bend back on itself and the open end of the tube placed over a nipple to seal it. Inserting a nipple into the end of an application tube from outside the application tube will itself displace fluid out from the application tube around the nipple resulting in foam being undesirably disposed around the nipple area and possibly the fingers of a user. In contrast to the device of '226, it is desirable to avoid having to insert anything from outside the dispensing tube into the end of the dispensing tube in order to seal the end.

The Dow Chemical Company offers a foam dispensing gun for GREAT STUFF PRO™ brand spray foam. The spray gun is available in three different grades: PRO 13, PRO 14 and PRO 15. Each of the guns has a port onto which a can of GREAT STUFF PRO™ brand spray foam attaches thereby releasing the compressed foam formulation into a barrel of the gun. Extending through the barrel is a rod that is spring loaded to seal from inside the barrel an outlet or dispensing end of the barrel. A trigger is attached to the spring loaded rod so that upon pulling the trigger the rod is retracted from the dispensing end of the barrel and foam formulation is free to flow from the can through the barrel around the retracted rod and out from the dispensing end. Upon release of the trigger the spring repositions the rod back into sealing position in the dispensing end of the barrel. This dispensing gun design requires a rod to extend through the barrel thereby decreasing the open volume inside the barrel available for transporting foam formulation and thereby restricting foam formulation flow through the barrel. It is desirable to have a dispensing device capable of sealing from the inside but without requiring a rod to extend through the entire barrel of the dispensing device.

BRIEF SUMMARY OF THE INVENTION

The present invention provides a dispensing device for compressed fluids that can seal the application tube from the inside thereby resolving the problem of expandable foamable mixtures from continuing to expel from the application tube while avoiding having to insert something from outside the application tube into the end of the dispensing tube or having a rod extend through the entire barrel of the dispensing device. Moreover, certain embodiments of the present invention are capable of remotely unsealing the dispensing tube to apply a compressed foamable liquid and then automatically sealing the application end of the dispensing tube at the will of a user. Even more, pressure from expanding foam formulation within a dispensing tube can automatically direct a plug to seal the tube at the will of the user without requiring a separate means (for example, a spring) for directing a plug to seal the dispensing tube. With the present invention, a user can avoid having to put their hands near the dispensing tube to seal or unseal it and thereby can avoid getting foam on their hands.

In a first aspect, the present invention is a dispensing device for dispensing compressed fluids from a can through a valve stem of the can, the dispensing device comprising: (a) a hollow tube defining a channel entirely through the tube from an entrance end to an opposing dispensing end; (b) a connector defining a conduit there-through with one end of the conduit mating with the channel of the hollow tube to provide fluid communication through the conduit and channel and where the opposing end of the conduit is designed to attach to the valve stem of the can; (c) a plug located in and able to move within the channel of the hollow tube, wherein the plug and hollow tube mate in a sealing configuration that seals the channel from fluid flow when the plug is pressed towards the dispensing end of the hollow tube; and (d) a sleeve that wraps at least partially around the hollow tube and having a protrusion that, upon activating the sleeve, extends through the dispensing end of the hollow tube and prevents the plug from establishing a sealing configuration with the hollow tube and thereby allows fluid communication from the channel through the dispensing end of the hollow tube.

In a second aspect, the present invention is a foam dispensing system comprising a can of compressed foamable formulation and the dispensing device of the first aspect, wherein the can has a valve stem to which the connector of the dispensing device can attach.

The dispensing device of the present invention is useful for dispensing compressed liquid, especially compressed foamable liquid from a can.

BRIEF DESCRIPTION OF THE DRAWINGS

FIGS. 1(*a*)-(*e*) illustrate a restraining mechanism for a sleeve that includes one type of mating ridge and groove.

DETAILED DESCRIPTION OF THE INVENTION

Figure 2A:
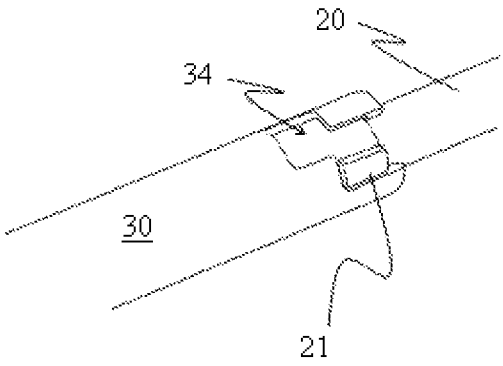
FIGS. 2(*a*)-(*c*) illustrate a restraining mechanism for a sleeve that includes a protuberance and a slot.

"And/or" means "and, or as an alternative". "Multiple" means "two or more". All ranges include endpoints unless otherwise indicated.

Applicants anticipate that aspects of any embodiment are combinable in an unlimited fashion with any aspects of any other embodiments unless such a combination is physically impossible.

The present invention is a dispensing device for dispensing compressed fluids from a can through a valve stem of the can. In the broadest scope of the invention, the type of compressed fluid is unlimited and can include both liquids and gases. However, the present invention is particularly useful for dispensing compressed foamable formulations that are in liquid form. Foamable formulations typically comprise a mixture of matrix material and blowing agent that is held under sufficient pressure to preclude expansion of the blowing agent until foaming is desired. Upon release of the pressure the blowing agent can expand within the matrix material to create foam. Common foamable polymer compositions include those having a matrix that forms a polyurethane polymer upon expanding and curing (that is, polyurethane foamable polymer compositions). Another type of foamable polymer composition comprises a latex matrix material that foams during expansion and coalesces to form polymer foam.

Cans of compressed fluid suitable for use with the present invention have a valve and valve stem through which contents within the can are dispensed. The valve of the can is the part of the can that reversibly seals and unseals to open or close the can for dispensing. The valve stem is a part to the valve that extends from the sealing portion of the valve and is typically tubular so the contents of the can are able to expel through the valve stem.

The dispensing device comprises a hollow tube that defines a channel there through. The hollow tube serves as a dispensing tube. The hollow tube has opposing entrance and dispensing ends. Fluid can enter the channel of the hollow tube through the entrance end and is able to flow through the channel of the tube and out from the channel through the dispensing end. The hollow tube and channel can have the same or different cross sectional shapes and can each be any conceivable shape. Typically, both the hollow tube and channel have a circular cross sectional shape. The cross sectional area of the channel can, and desirably does, taper down in size proximate to the dispensing end. The cross sectional area of the channel can, alternatively, suddenly reduce in size in a step-wise fashion at or proximate to the dispensing end. Having a smaller cross sectional area proximate to the dispensing end is desirable to help facilitate sealing the channel with a plug as described further below. The hollow tube can be of any conceivable shape including straight or curved, although straight is more desirable. The hollow tube can comprise a single piece or multiple pieces. For example, the hollow tube can comprise removable tips that attach to the hollow tube and serve as the dispensing end of the hollow tube. The removable tips can be designed to constrict and/or redefine the direction or shape of fluid flow from the channel of the hollow tube through the dispensing end. For example, the tip can distribute the flow of fluid into a fan pattern to facilitate application of fluid over a wide surface area. The tip can also constrict fluid flow by reducing the cross sectional area of the dispensing end of the channel, which can be useful if the plug (discussed below) is designed to mate with the removable tip to form a seal when pressed against the removable tip.

The hollow tube is desirably plastic but can be made of essentially any material. For example, the hollow tube can be metal or a combination of plastic and metal components. Desirably, the hollow tube is made of material that is relatively inert to the compressed fluid it dispenses can so that the hollow tube does not deteriorate or decompose during use.

The hollow tube is mated with a connector that provides an interface, or linking device, between the hollow tube and the valve stem of a can of compressed fluid. The connector defines a conduit (or, a channel) through it. The conduit has at least, and preferably has only, two openings or ends to the outside of the connector. One of the openings mates the conduit of the connector with the channel of the hollow tube. The other opening of the conduit attaches to and mates with the valve stem of a can.

The hollow tube "mates" or is "mated" with the connector, which means that the entrance end of the hollow tube connects to the connector in such a way that the channel through the hollow tube is in fluid communication with the conduit through the connector through one end of the conduit. The channel of the hollow tube essentially serves as a continuation of the conduit through the connector.

The hollow tube and connector can be a single piece or multiple pieces. As a single piece the hollow tube and connector are either permanently connected or formed (for example, molded) as a single piece. As multiple pieces, the hollow tube can be separable from the connector. For example, the hollow tube can be a straw with an entrance end that fits over a nipple defined in the connector so that once the straw is put over the nipple the channel of the straw and the conduit of the connector are in fluid communication. See, for example, FIG. 3(*b*).

The connector can be made of the same material as the hollow tube or different material. However, the connector is generally made from the same types of materials that are suitable for the hollow tube.

The opening of the conduit that attaches to the valve stem of a can mates with the valve stem when the dispensing device is attached to a can, which means the conduit of the connector forms a sealed connection with the valve stem of the can so there is fluid communication through the valve stem into the conduit of the connector. Therefore, when the dispensing device is attached to a can there is fluid communication through the valve stem into and through the conduit of the connector and into the channel of the hollow tube. For example, outer (exposed) walls of the valve stem and inside walls of the connector conduit can have mating threads such that the connector can screw onto and over the valve stem to attach the dispensing device to the can (see, for example, FIG. 3(*b*)). The connector can attach to the valve stem by any possible means provided that there is fluid communication through the valve stem and into the conduit of the connector. Other possible means of attaching a connector to a valve stem include frictional mating (connector slides over valve stem with friction holding it in place), snapping the connector over a valve stem in such a manner the valve stem in such a manner that the two reversibly, or non-reversibly, lock together. Locking means include mating ridge and groove features or slot and protuberance features as described below for the sleeve.

The connector can comprise a trigger structure. Desirably, the trigger structure extends off from one side of the connector so that when the connector is attached to the valve stem of a can pulling the trigger tips the connector and valve stem in the valve causing compressed fluid to be released through the valve and valve stem into the conduit of the connector. An alternative trigger design includes a trigger structure that facilitates application of pressure directly down onto the valve stem and valve of a can when attached to the valve stem. For example, the trigger structure can be symmetric about the connector so that applying pressure to the trigger structure pushes the valve stem into the valve without tilting thereby opening the valve to release compressed fluid in the can to flow through the valve and valve stem into the conduit of the connector.

A plug is located within the channel of the hollow tube. The plug can move within the channel of the hollow tube when there is an absence of fluid in the hollow tube applying pressure against the plug. The plug is designed to mate in a sealing configuration with the hollow tube when the plug is pressed towards the dispensing end of the hollow tube (for example, by pressing against the walls of the hollow tube channel or an insert such as an O-ring within the channel of the hollow tube). When the plug and hollow tube mate in a sealing configuration the plug can, for example, contact the hollow tube walls (that portion of the hollow tube around the channel) or a component or components within the hollow tube (for example, an O-ring or gasket set in a recess within the wall of the hollow tube and exposed within the channel). There are many options for such a plug and hollow tube design and one of ordinary skill in the art can readily conceive of manifestations of such designs. For example, the channel of the hollow tube can be tapered towards the dispensing end of the hollow tube so that as the plug is pressed towards the dispensing end the plug presses against the walls of the channel to seal off fluid communication past the plug. Additionally, or alternatively, there may be a constriction, even a sudden rather than tapered constriction, at or proximate to the dispensing end that defines an aperture through the channel that has a cross sectional area that is smaller than previous cross sectional areas in the channel and the plug can fit into the aperture so as to seal the aperture when pressed towards the dispensing end. As previously noted, the dispensing end can comprise a removable tip that is designed to mate in a sealing configuration with the plug when the plug is pressed into the removable tip. The hollow tube can comprise an O-ring within the channel, desirably inset into a recess of the hollow tube wall defining the channel, against which the plug presses when in a sealed configuration.

While the plug is of sufficient dimensions to form a sealing configuration when pressed towards the dispensing end of the hollow tube, it is also of sufficiently small dimension to allow fluid to flow through the channel and around the plug when not in a sealing configuration. For example, the channel can have a circular cross section with a main diameter that reduces to a reduced diameter at the dispensing end while the plug has a circular cross sectional with a diameter that is smaller than the main diameter and larger than the reduced diameter of the hollow tube channel. In this example, the plug forms a sealing configuration with the channel when pressed towards the dispensing end because it has a larger diameter than the channel at the dispensing end. However, when displaced away from the dispensing end into a portion of the channel having a main diameter there is fluid communication around the plug within the channel. It is straightforward to extend this example to other cross sectional shapes beyond circular by, for example, using similar concepts of proportions of cross sectional shapes between the plug and sections of the hollow tube channel.

In its broadest scope, the plug can be a spherical shape (that is, like a ball) or can have a length that exceeds its cross sectional dimensions. Desirably, the plug has a length that exceeds its cross sectional dimensions. Still more preferably, the plug has a length that exceeds the cross sectional dimensions of the channel so that the end of the plug most proximate to the dispensing end is always the end of the plug most proximate to the dispensing end. That way, the plug always forms a seal in the channel with the same end of the plug. For avoidance of any doubt, the length of the plug refers to a dimension that extends in a direction perpendicular to the cross section of the plug and hollow tube and parallel to the direction fluid flows in the hollow tube when flowing from the entrance end to the dispensing end.

It is desirable for the end of the plug most remote from the dispensing end of the hollow tube to have as large of a cross sectional area as possible so that expanding fluid within the hollow tube most efficiently presses the plug into a sealing configuration. Hence, one desirable plug has a flat surface opposite from its sealing surface and against which fluid presses as the fluid flows through the channel.

At least a portion of the plug, the portion that makes contact with the hollow tube to form a seal when in a sealing configuration, is desirably elastically deformable so that it can conform to the shape of the channel cross section as it is pressed against the hollow tube when in a sealing configuration. The entire plug can be elastically deformable. Alternatively, or additionally, that portion of the hollow tube (including any components such as an O-ring against with the plug can press to form a seal) is desirably elastically deformable to conform to the shape of the plug pressing against it. Elastically deformable material suitable for the plug and or hollow tube, or at least the portion that is elastically deformable, includes rubber, silicone, and plastic.

It is desirable for the plug to remain relatively close to the dispensing end of the hollow tube relative to the entrance end of the hollow tube. Therefore, the hollow tube can comprise a ridge or ridges ("ridge(s)") extending into the channel between the plug and entrance end of the hollow tube. The ridges prevent the plug from passing by them in the channel of the hollow tube. The distance between the ridge(s) and the dispensing end of the channel is greater than the length of the plug so that the plug has room to move between the ridge(s) and its sealing configuration. The length of the plug refers to the plug dimension extending perpendicular to the channel cross section when the plug is within the channel.

The ridge(s) can be of any shape or form provided that they prevent passage of the plug past them in the channel of the hollow tube. For example, ridge(s) can be a single protrusion of any dimension, a combination of protrusions of any dimension, or a circumferential indentation on the the hollow tube that protrudes into the channel. A sleeve wraps at least partially around the hollow tube on the outside of the hollow tube. For avoidance of any doubt, the channel is inside of the hollow tube and the exposed surface of the hollow tube is the outside surface of the hollow tube. Desirably, the sleeve wraps sufficiently around the hollow tube so as to hold the sleeve from falling away from the hollow tube. Preferably, the sleeve wraps entirely around the hollow tube. However, in wrapping around the hollow tube either partially or entirely the sleeve remains capable of sliding along the outside surface of the hollow tube.

The sleeve comprises a portion that extends off from the hollow tube past the dispensing end of the hollow tube and further comprises a protrusion ("sleeve protrusion") that extends through the dispensing end into the channel of the hollow tube when the sleeve is activated, and optionally also when the sleeve is deactivated. The sleeve protrusion is small enough so that even when inserted through the dispensing end of the hollow tube fluid can still flow out of the hollow tube through the dispensing end tube. The sleeve protrusion can be attached to the sleeve, for example, by a single support bar that extends partially or, preferably, entirely across a cross sectional dimension of the sleeve. See, for example, FIGS. 1(*a*)-(*e*), which is described further below. FIG. 1(*a*) illustrates an angled view into the dispensing end of dispensing device 10 while FIGS. 1(*b*)-(*e*) illustrate cut-away views of dispensing device 10 along viewing line A for FIGS. 1(*b*) and 1(*c*) and viewing line B for FIGS. 1(*d*) and 1(*e*). Dispensing device 10 comprises hollow tube 20 and sleeve 30. Sleeve 30 comprises protrusion 32 attached to sleeve 30 by support bar 34. Support bar 34 extends entirely across a cross sectional dimension of sleeve 30 in FIGS. 1(*a*)-(*e*).

It is desirable to have the support bar inside of the sleeve. That is, it is desirable to have at least a portion of the sleeve extending on both sides of the support bar in the direction of fluid flow. It is even more desirable for a portion of the sleeve downstream from the support bar (relative to fluid flow; on the opposite side of the support bar from the hollow tube) to taper down in at least one, preferably each cross sectional dimension. By tapering down in cross sectional dimension after the support bar, fluid that is deflected around the support bar and protrusion is redirected together in order to avoid forming voids in the dispensed fluid stream. Tapered tip 31 in FIGS. 1(*b*)-(*e*) is an illustration of an example such a tapered portion of the sleeve downstream from support bar 34 of sleeve 30.

The sleeve is "activated" when the protrusion extends through the dispensing end of the hollow tube a sufficient distance so as to displace the plug from a sealing configuration and/or prevent the plug from establishing a sealing configuration. Activating the sleeve establishes and/or ensures that there is fluid communication through the hollow tube past the plug and through the dispensing end of the hollow tube. The sleeve is "deactivated" when in a position where the protrusion does not prevent the plug from establishing or maintaining a sealing configuration within the channel of the hollow tube. Activating the sleeve (that is, moving the sleeve to an activated position) when in a deactivated position comprises sliding the sleeve along the hollow tube towards the entrance end of the hollow tube. Deactivating the sleeve (that is, moving the sleeve to a deactivated position) when the sleeve is in an activated position comprises sliding the sleeve along the hollow tube away from the entrance end of the hollow tube.

The sleeve protrusion can be attached to the plug so that activating the sleeve disengages the plug from a sealing configuration and deactivating the sleeve actively positions the plug into a sealing configuration. In this embodiment, deactivating the sleeve actually pulls the plug into a sealing configuration. This type of embodiment is particularly desirable for use with cans of non-expanding fluids because the fluid in the hollow tube channel does not actively expand to press the plug into a sealing configuration.

Alternatively, the sleeve protrusion can be unattached and distinct from the plug. That is, the plug can be free to move apart from the sleeve protrusion. Having the sleeve protrusion unattached and distinct from the plug makes construction of the dispensing device easier than if the two are attached and also allows the plug to be free to make minor positional adjustments and conform to the channel as it enters a sealing configuration within the channel. If the sleeve protrusion is unattached from the plug it is desirable that the plug has an indentation or dimple to receive the sleeve protrusion as the sleeve is activated. When the sleeve protrusion is unattached and distinct from the plug activating the sleeve can actively disengage the plug from a sealing configuration while deactivating the sleeve does not in and of itself actively position the plug into a sealing configuration. Upon deactivating the sleeve pressure from the compressed fluid in the channel of the hollow tube pushes the plug towards the dispensing end and into a sealing configuration thereby sealing the channel. For example, foamable polymer composition in the hollow tube can press the plug into a sealing configuration in the channel of the hollow tube as the foamable polymer composition attempts to expand within the hollow tube. As such, the plug prevents expanding foamable polymer composition from expelling out from the tube unless a user activates the sleeve.

The sleeve can be made of the same material or different material as to the hollow tube but is generally selected from the same types of materials suitable for the hollow tube. The sleeve and its components can all be made of the same material or can comprise multiple materials. For example, the sleeve itself can be plastic while the sleeve protrusion can be metal (or vice versa).

While dispensing compressed fluid through the dispensing device of the present invention the compressed fluid applies a pressure against the plug that directs the plug towards the dispensing end of the hollow tube. Therefore, in order to dispense fluid through the dispensing device it is necessary to maintain the sleeve in an activated position. A user can actively hold the sleeve in an activated position while dispensing the compressed fluid.

The sleeve can also be sufficiently tight around the hollow tube so that the force of friction to move the sleeve from an activated position is greater than the force the fluid applies to the plug as the fluid travels through the channel of the hollow tube. While these options are acceptable for the broadest scope of the invention, it is desirable for the dispensing device to further comprise a restraining mechanism that retains the sleeve in an activated position until the sleeve is affirmatively deactivated by a user. That is, the restraining mechanism retains the sleeve in an activated position until the user affirmatively deactivates the sleeve to cease dispensing fluid through the dispensing device. There are a multitude of possible manifestations of a suitable restraining mechanism and the descriptions below exemplify just a few of the options.

The restraining mechanism can comprise a mating ridge and groove configuration between the inside surface of the sleeve and outside surface of the hollow tube. The inside surface of the sleeve is that portion of the sleeve that is adjacent to the hollow tube. The outside surface of the hollow tube is that portion of the hollow tube adjacent to the sleeve as the sleeve slides over the hollow tube. The inside surface of the sleeve defines either a groove or a ridge that extends at least partially circumferentially around the surface while the outside surface of the hollow tube defines the other of a groove or ridge extending at least partially circumferentially around the hollow tube. When the sleeve is activated the ridge sets within the groove thereby preventing the sleeve to slide over the outside surface of the hollow tube unless more force is applied than the fluid flowing through the hollow tube channel provides. To deactivate the sleeve once activated a user applies sufficient force to disengage the groove and ridge from their mating orientation to slide the sleeve away from the entrance end of the hollow tube. The groove or ridge member on the sleeve will be located between the ridge or groove member on the hollow tube when the sleeve is deactivated and the plug is in its sealing configuration. The ridge or groove in the sleeve can also mate with a groove or ridge on the outside of the hollow tube when in a deactivated position to hold the sleeve securely in place.

FIGS. 1(*a*)-1(*e*) illustrate a mating ridge and groove restraining mechanism. FIG. 1(*a*) illustrates an angled view into the dispensing end of dispensing device 10. Dispensing device 10 comprises hollow tube 20 and sleeve 30. Sleeve 30 comprises protrusion 32 attached to sleeve 30 by support bar 34. FIGS. 1(*b*) and 1(*c*) illustrate cut-away views of dispensing device 10 along viewing line A as shown in FIG. 1(*a*). FIGS. 1(*d*) and 1(*e*) illustrate cut-away views of dispensing device 10 along viewing line B as shown in FIG. 1(*a*). FIGS. 1(*b*) and 1(*d*) illustrate sleeve 30 in a deactivated position and plug 40 in a sealed configuration within channel 22 of hollow tube 20 thereby sealing off the hollow tube opening at the dispensing end 24. Groove 50 extends circumferentially around inside surface 36 of hollow tube 30. Ridge 60 extends circumferentially around outside surface 26 of hollow tube 20. When sleeve 30 is in the deactivated position as in FIG. 1(*b*) groove 50 and ridge 60 remain remote and unengaged. FIGS. 1(*c*) and 1(*e*) illustrate sleeve 30 in an activated position with protrusion 32 displacing plug 40 from a sealing configuration and with groove 50 and ridge 60 engaged in a locked position.

The restraining mechanism can comprise a twist lock mechanism with a protuberance extending out from the outside surface of the hollow tube and a main slot defined in the sleeve that receives the protuberance as the sleeve slides over the protuberance. See, for example, the sleeve and tube configuration in FIGS. 2(*a*)-(*c*). Sleeve 30 slides over hollow tube 20 with protuberance 21 extending out from the surface of hollow tube 20 and fitting into slot 34 of sleeve 30. The sleeve can twist to direct the protuberance into a side slot off from the main slot to lock the sleeve into place to lock the sleeve into an activated position (as FIG. 2(*c*) illustrates). To allow the sleeve to deactivate and the plug to position into a sealing configuration the sleeve must be twisted to align the protuberance with the main slot and the sleeve slit away from the entrance end of the hollow tube with the protuberance traveling along the main slot (as FIG. 2(*b*) illustrates). Optionally, a side slot can also be available to lock sleeve into a deactivated position (as FIG. 2(*a*) illustrates).

The restraining mechanism can comprise a flexible (bendable) yet inelastic (not easily stretched) extension piece having opposing first and second ends with the first end attached to the sleeve and the second end capable of attaching to a can when the connector of the dispensing device is attached to the valve stem of the can. For example, the second end can comprise a clip that fastens (desirably, reversibly so it can be removed) to a valve skirt of a can. The extension piece is sufficiently long so as to reach to the can when the sleeve is in a deactivated position. The extension piece is sufficiently short such that when the dispensing device is attached to the valve stem of a can and the second end of the extension piece is attached to the can tilting the dispensing device and valve with respect to the can away from the extension piece pulls the sleeve to an activated position. The flexible inelastic extension piece can comprise plastic or metal ribbon, wire and/or strips. The clip that fastens to the can (for example, the valve skirt) can be a separate piece attached to the flexible inelastic extension piece or can be molded or defined directly as part of the inelastic extension piece. The clip can be the same material or different material from the inelastic extension piece.

When using a flexible inelastic extension piece it is desirable to stabilize the position of the extension piece with respect to the connector by having the extension piece flexibly connected to the connector. Flexibly connecting the extension piece and connector should retain the position of the extension piece with respect to the connector yet allow the connector to bend or tilt in the valve while the extension piece is attached to the can. One desirably way to flexibly connect the extension piece to the connector is with a piece of flexible plastic in a curved, corrugated, helical or any other shape that allows for extension through bending.

It is also desirable for the dispensing device to also comprise guides that align and keep aligned the extension piece with respect to the hollow tube and connector during use. For example, if the extension piece is a ribbon or wire it is helpful to have as guides slots on the outside of the hollow tube and/or connector between or through which the extension piece extends. In addition, or alternative to the slots, the extension piece can comprise a stabilizing wrap around the hollow tube to help retain alignment with the hollow tube.

FIGS. 3(*a*)-(*d*) illustrate exemplary dispensing device 10 (not necessarily the same as dispensing device 10 in FIG. 1 or 2) attached to valve stem 110 of can 100). FIGS. 3(*a*) and 3(*b*) are illustrations of dispensing device 10 and can 100 in a deactivated orientation, with FIG. 3(*b*) providing a cut-away view of FIG. 3(*a*) to show inside the components. FIG. 3(*c*) illustrates dispensing device 10 and can 100 in an activated orientation with dispensing device 10 and valve stem 110 tipped with respect to can 100 to release compressed fluid from can 100.

Figure 2B:
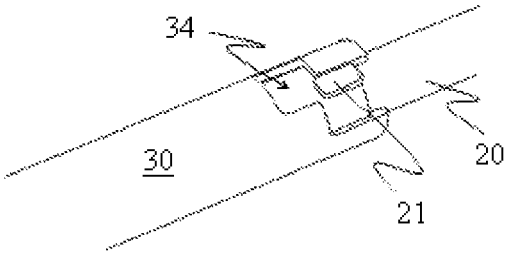
Figure 2C:
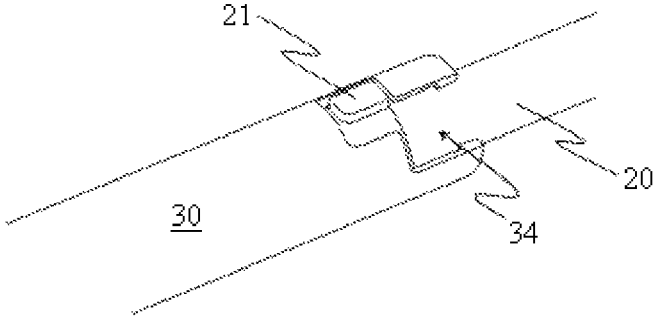
Figure 3A:
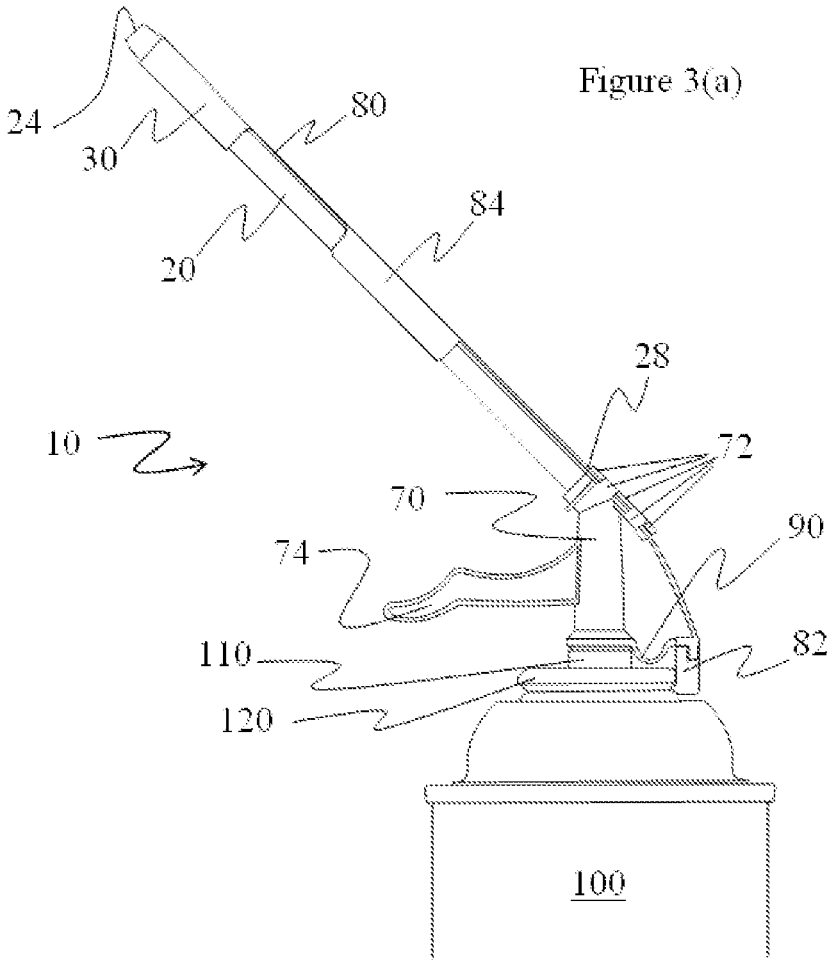
FIGS. 3(*a*)-(*d*) illustrate a dispensing device of the present invention with an extension piece that attaches to a can.
Figure 3B:
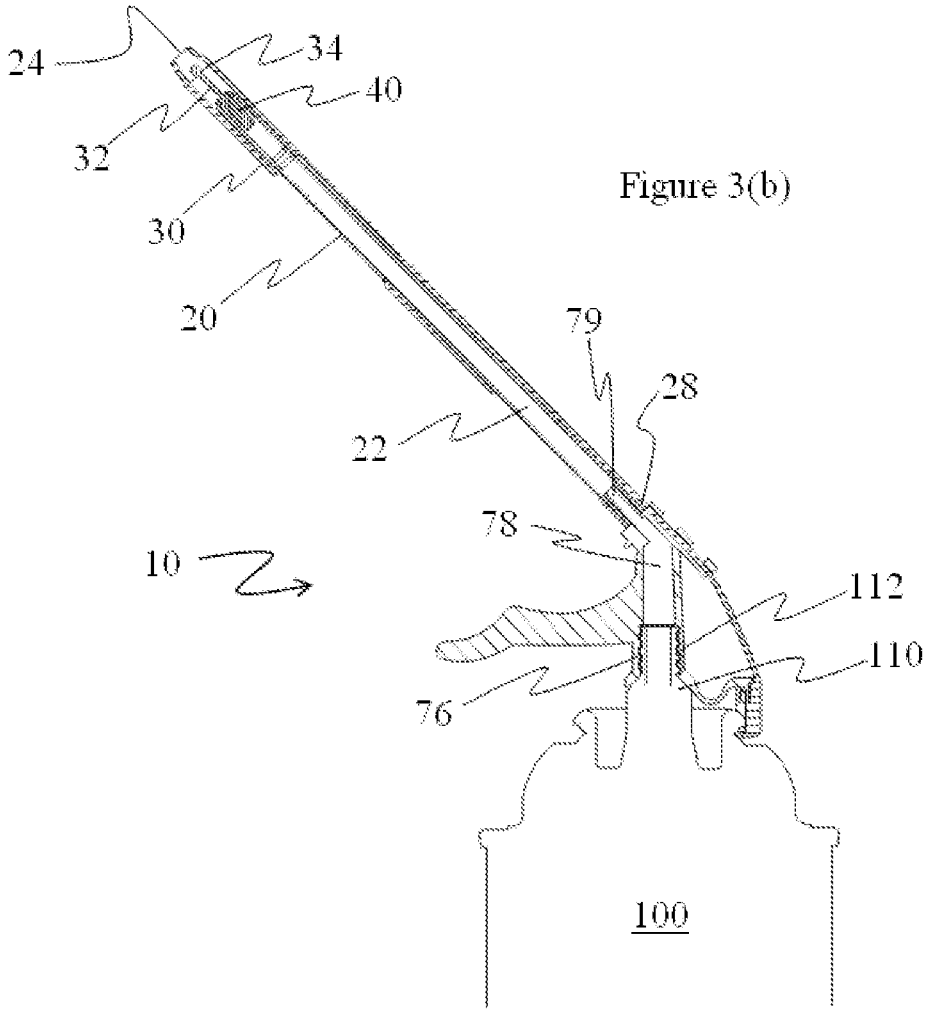
Figure 3C:
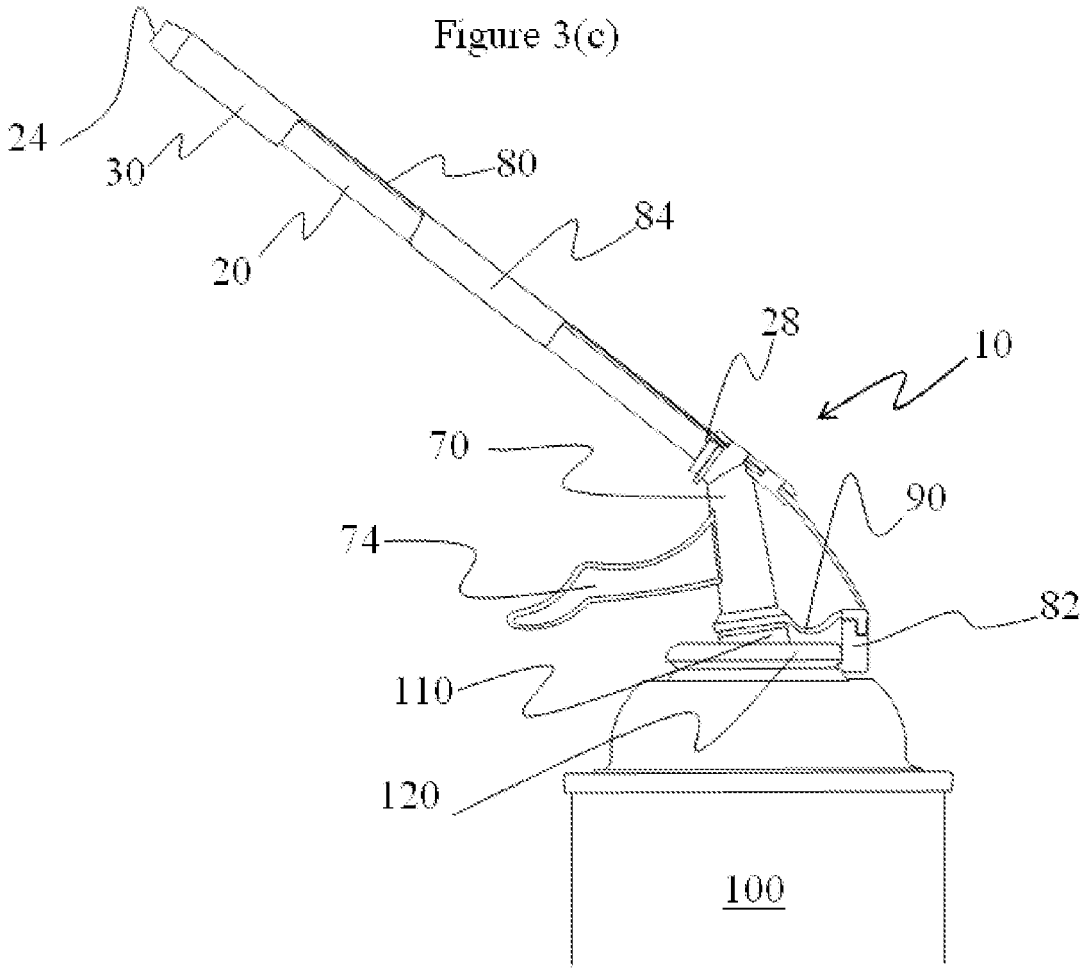
Figure 3D:
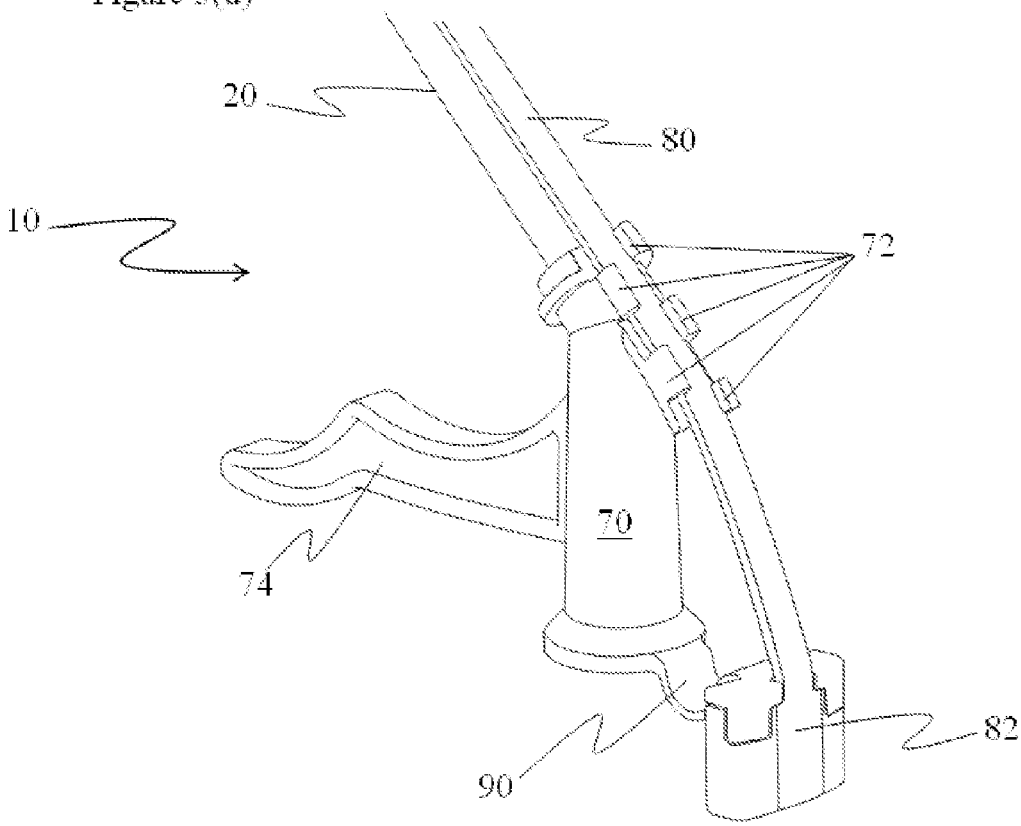

Dispensing device 10 comprises hollow tube 20, sleeve 30 with sleeve protrusion 32 (see FIG. 3(*b*)), plug 40 (see FIG. 3(*b*)), connector 70 and flexible inelastic extension piece 80. Hollow tube 20 defines channel 22 (see FIG. 3(*b*)) which extends from entrance end 28 to exit end 24 of hollow tube 20. Connector 70 has conduit 78 (see FIG. 3(*b*)) defined through it. Conduit 78 is in fluid communication with channel 22 through nipple 79 (see FIG. 3(*b*)); over which entrance end 28 of hollow tube 20 fits. Connector 70 has screw threads 76 defined in a wall of conduit 78 that screw onto mating threads 112 of valve stem 110 to attach connector 70 to valve stem 110. Extension piece 70 attaches to sleeve 30 and extends along and outside of hollow tube 20 from sleeve 30 to valve skirt 120 of can 100. Extension piece 80 comprises clip 82 that fastens to valve skirt 120. Flexible connector 90 is a curved ribbon of plastic that is attached to both connector 70 of dispensing device 10 and clip 82 to stabilize the position of the extension piece with respect to connector 70. In the embodiment of FIG. 2, flexible connector 90 is reversibly attachable to clip 82. Connector 70 comprises trigger 74 that extends from connector 70 in an opposite direction from flexible connector 90 and extension piece 70. Extension piece 80 comprises stabilizing wrap 84 that extends around and is able to slide along hollow tube 20 to help maintain positioning of extension piece 80. Connector 70 further comprises guide slots 72 through with extension piece 80 extends and can slide. Guide slots 72 serve to help maintain alignment of extension piece 80 with respect to hollow tube 20 and connector 70. FIG. 3(*d*) provides an alternative view of guide slots 72.

When the connector comprises a trigger on only one side of the connector, the extension piece extends to the can along a side opposite the trigger. In such a configuration, pulling the trigger when the connector is attached to a valve stem of a can tilts the connector and valve stem away from where the extension piece connects to the can, resulting in the extension piece pulling the sleeve away from the dispensing end of the tube thereby activating the sleeve. FIG. 3(*a*) illustrates dispensing device 10 attached to can 100 in a non-activated or deactivated orientation. FIG. 3(*c*) illustrates this same dispensing device 10 on the same can 100 in an activated orientation where valve stem 110 and dispensing device 10 have been tilted with respect to can 100 to release compressed fluid from can 100, through valve stem 110, connector 70, hollow tube 20 and out dispensing end 24. Tilting dispensing device 10 and valve stem 110 further causes sleeve 30 and stabilizing wrap 84 to slide along hollow tube 20 towards entrance end 28, which in turn causes protrusion 32 (see FIG. 3(*b*)) to displace plug 40 from a sealing configuration in hollow tube 20. The tilting occurs away from clip 82 of extension piece 80. Extension piece 80, retained by clip 82 to valve skirt 120, pulls sleeve 30 and stabilizing wrap 84 along hollow tube 20 as tilting occurs. When dispensing device 10 and valve stem 110 are allowed to return to their deactivated position as shown in FIG. 3(*a*), tension is relieved along extension piece 80 allowing sleeve 30 and stabilizing wrap 84 to return towards dispensing end 24 and allowing plug 40 to return to a sealing configuration within hollow tube 20.

Use of an extension piece attached to the can is desirable because it automatically activates the sleeve, hence automatic opens the channel of the hollow tube, upon tilting the connector and valve stem of a can in the can valve away from the connection between the can and extension piece to release compressed fluid from the can. Allowing the connector and valve stem to return the can valve to a closed position automatically deactivates the sleeve which either actively pulls the plug into a sealing configuration (when the sleeve protrusion is attached to the plug) or allows the expanding fluid in the hollow tube channel to push the plug into a sealing configuration. Hence, opening and closing of the seal between the plug and hollow tube channel is automatically correlated to opening and closing the can valve.

Figure 4:
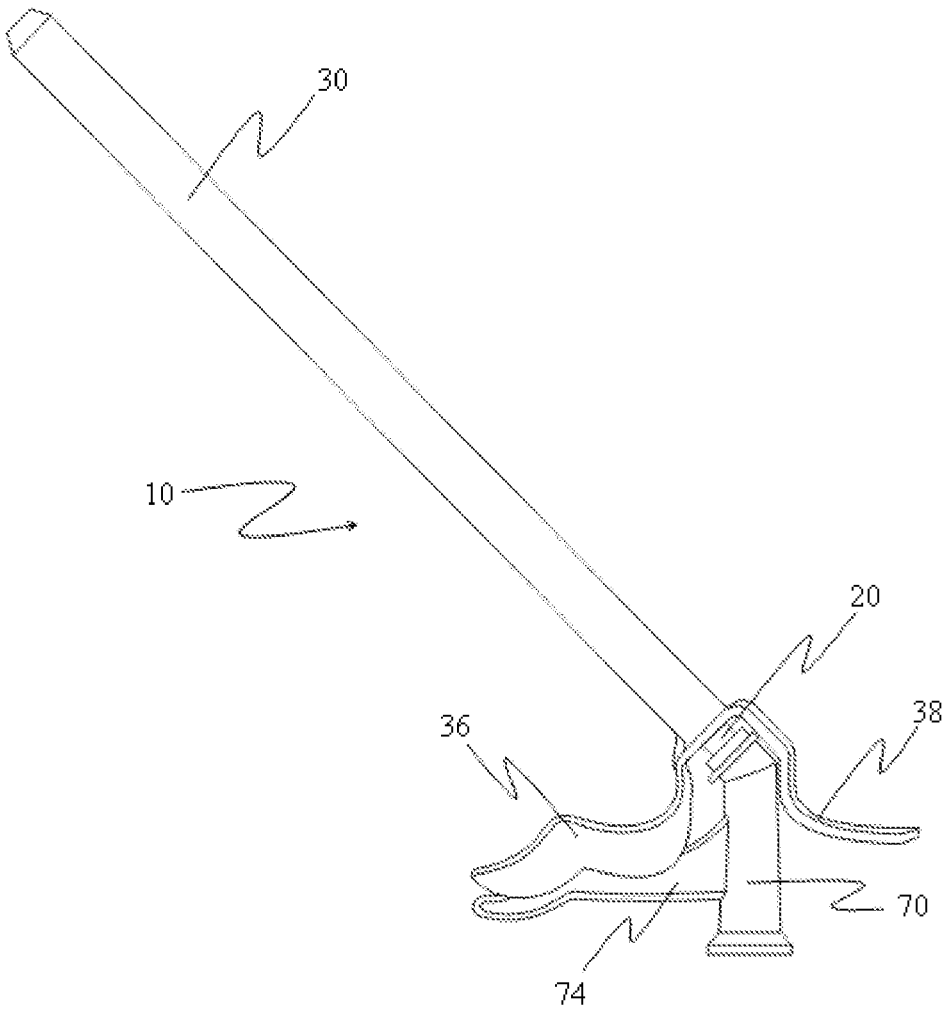
FIG. 4 illustrates another dispensing device of the present invention with a trigger attached to the sleeve.

In another embodiment, the sleeve comprises a trigger ("sleeve trigger") either directly attached to the sleeve or connected to the sleeve by an extension piece. Desirably, the sleeve trigger is proximate to the trigger on the connector. Pulling the sleeve trigger towards the can or towards to the connector trigger activates the sleeve by pulling it towards the entrance end of the hollow tube. Holding the trigger in a pulled position retains the sleeve in an activated position. Releasing the extension trigger allows the expanding fluid in the channel of the hollow tube to press the plug into a sealing configuration and in the process slide the sleeve into a deactivated position as the plug pushed the sleeve protrusion. FIG. 4 provides an illustration of one example of this type of embodiment of the present invention. In FIG. 4, sleeve 30 extends nearly the full length of hollow tube 20 and comprises sleeve trigger 36 and clip/finger pull 38. Sleeve trigger 36 fits over trigger 74 of connector 70. Pulling sleeve trigger 36 and clip/finger pull 38 away from the dispensing end of hollow tube 20 positions sleeve 30 in an activated position. As illustrated in FIGS. 1(*c*), 1(*e*) and 3(*c*), when sleeve 30 is in an activated position a sleeve protrusion 32 (not shown) displaces plug 40 (not shown) from a sealed position in the channel of hollow tube 20. Releasing trigger 36 and clip/finger pull 38 allows expanding fluid in the channel of hollow tube 20 to press plug 40 back into a sealing configuration in the channel and at the same time slide sleeve 30 along hollow tube 20. While sleeve 30 is in an activated position, application of further pressure to trigger 24 tilts dispensing device 10 and valve stem 110 (not shown) with respect to can 100 (not shown) to release compressed fluid from can 100 and direct it through dispensing device 10.

The dispensing device of the present invention is useful as part of a foam dispensing system comprising a can of compressed foamable formulation and the dispensing device. The can of the compressed foamable formulation comprises a valve stem that mates with the connector of the dispensing device to allow the dispensing device to attach to the can. Suitable foamable formulations include polyurethane-based foam formulations as well as latex-based foam formulations. One of the advantages the present invention has over prior art is that it can open and close the tube without requiring a spring, particularly a spring that applies a force on an objected to seal the hollow tube, particularly the dispensing end. The present invention can be free of springs that apply a force on an object to seal the hollow tube, particularly the dispensing end, and can be free of springs altogether.

What is claimed is:

1. A dispensing device for dispensing compressed fluids from a can through a valve stem of the can, the dispensing device comprising:

(a) a hollow tube defining a channel entirely through the tube from an entrance end to an opposing dispensing end;

(b) a connector defining a conduit there-through with one end of the conduit mating with the channel of the hollow tube to provide fluid communication through the conduit and channel and where the opposing end of the conduit is designed to attach to the valve stem of the can;

(c) a plug located in and able to move within the channel of the hollow tube, wherein the plug mates with the hollow tube in a sealing configuration that seals the channel from fluid flow when the plug is pressed towards the dispensing end of the hollow tube; and (d) a sleeve that wraps at least partially around the hollow tube and having a protrusion that, upon activating the sleeve, extends through the dispensing end of the hollow tube and prevents the plug from establishing a sealing configuration with the hollow tube and thereby allows fluid communication from the channel through the dispensing end of the hollow tube;

wherein the dispensing device is free of a spring that applies a force on an object to seal the hollow tube at the dispensing end.

2. The dispensing device of claim 1, further characterized by the channel through the hollow tube having a tapered cross sectional area that reduces in cross sectional size proximate to the dispensing end.

3. The dispensing device of claim 1, wherein the protrusion of the sleeve attaches to the sleeve by means of a support bar that is located within the sleeve in front of the dispensing end of the hollow tube and wherein the sleeve tapers to a smaller cross sectional dimension downstream from the support bar.

4. The dispensing device of claim 1, further characterized by a restraining mechanism that upon activating the sleeve retains the sleeve in an activated position until the sleeve is affirmatively deactivated.

5. The dispensing device of claim 4, where the restraining mechanism is selected from:

i. a mating groove defined at least partially circumferentially around either the sleeve or hollow tube and a ridge that fits into the groove defined at least partially circumferentially around the other of the sleeve or hollow tube where the groove and ridge are defined on the surfaces facing one another as the sleeve slides over the hollow tube; and ii. a protuberance extending out from the outside of the hollow tube and a main slot defined in the sleeve that receives the protuberance as the sleeve slides over the protuberance, the main slot having a side slot extending off from it into which the protuberance can be positioned by twisting the sleeve with respect to the hollow tube while in an activated position.

6. The dispensing device of claim 4, further characterized by the restraining mechanism comprising a flexible and inelastic extension piece having opposing first and second ends with the first end attached to the sleeve, the inelastic extension piece being of sufficient length so that the second end reaches the can when the connector is attached to the can valve stem, the second end designed to attach to the can.

7. The dispensing device of claim 6, further characterized by second end of the extension piece comprising a clip for attaching to the valve skirt of the can.

8. The dispensing device of claim 7, further characterized by the extension piece being flexibly connected to the connector of the dispensing device.

9. The dispensing device of claim 6, further characterized by guides that align the extension piece along the hollow tube and through which the inelastic extension piece can slide.

10. The dispensing device of claim 6, further characterized by the connector comprising a trigger structure extending from one side of the connector and the extension piece attached to the sleeve extending along the hollow tube and on a side of the connector opposite of the trigger.

11. The dispensing device of claim 1, further characterized by the protrusion of the sleeve and the plug being distinct and unattached to one another.

12. The dispensing device of claim 11, further characterized by the hollow tube having a ridge extending into the channel and located a distance from the dispensing end that is greater than the length of the plug and between the plug and entrance end of the channel such that the plug is able to move in the channel between the dispensing end and the ridge when the sleeve is not activated.

13. The dispensing device of claim 1, wherein at least a portion of at least one of the plug and the hollow tube is elastically deformable wherein the elastically deformable portion participates in the mating between the plug and the hollow tube to form a seal when the plug is pressed into sealing configuration.

14. The dispensing device of claim 1, further characterized by the sleeve comprising a sleeve trigger either directly attached to the sleeve or connected to the sleeve by an extension piece.

15. A foam dispensing system comprising a can of compressed foamable formulation and the dispensing device of claim 1, wherein the can has a valve stem to which the connector of the dispensing device can attach.

* * * * *